US005316143A

United States Patent [19]

Horn

[11] Patent Number: 5,316,143

[45] Date of Patent: May 31, 1994

[54] DEVICE FOR HOLDING CYLINDRICAL SOCKET HEADS

[76] Inventor: Billy L. Horn, 1313 Greenbriar, Rapid City, S. Dak. 57701

[21] Appl. No.: 959,117

[22] Filed: Nov. 12, 1992

[51] Int. Cl.[5] ..... B65D 85/70

[52] U.S. Cl. ..... 206/378; 206/350; 206/443; 206/818; 211/70.6; 211/DIG. 1

[58] Field of Search ..... 206/350, 378, 818, 443; 211/70.6, DIG. 1; 335/285

[56] References Cited

U.S. PATENT DOCUMENTS

| | | | |
|---|---|---|---|
| 563,787 | 7/1896 | Moyer | 335/285 X |
| 2,217,514 | 10/1940 | Henry . | |
| 2,457,032 | 12/1948 | Case . | |
| 2,457,421 | 12/1948 | Warren . | |
| 2,527,482 | 10/1950 | Kinzler et al. . | |
| 2,565,624 | 8/1951 | Phelon | 211/70.6 X |
| 2,955,789 | 10/1960 | Smith . | |
| 2,966,992 | 1/1961 | Dunkelberger et al. . | |
| 3,095,525 | 6/1963 | Hansen | 335/285 |
| 3,204,776 | 9/1965 | Brown et al. . | |
| 3,212,546 | 10/1965 | Lind . | |
| 3,229,820 | 1/1966 | Hentzi et al. . | |
| 3,405,377 | 10/1968 | Pierce . | |
| 3,481,462 | 12/1969 | Chapel . | |
| 3,532,221 | 10/1970 | Kaluhiokalani et al. . | |
| 4,451,810 | 5/1984 | Miller . | |
| 4,497,412 | 2/1985 | Labelle | 206/350 X |
| 4,544,067 | 10/1985 | Miller . | |
| 4,591,817 | 5/1986 | Miller . | |
| 4,802,580 | 2/1989 | Andersen . | |
| 4,826,059 | 5/1989 | Bosch et al. . | |
| 5,080,230 | 1/1992 | Winnard . | |

*Primary Examiner*—Bryon P. Gehman

*Attorney, Agent, or Firm*—Palmatier, Sjoquist & Helget

[57] ABSTRACT

The invention relates to a device for magnetically holding sockets in a desired horizontal sequence. One embodiment of the device is substantially rectangular having a plurality of parallel channels of descending circumference adapted to receive corresponding socket heads from a standard or long socket set. The device promotes a plurality of magnetic arcs, having pole lines parallel to the channels, for engagement to the exterior circumference of the cylindrical sockets. The magnetic attraction properties of the device offer a significant improvement over the prior art while simultaneously providing maximum visibility of the socket heads which facilitate retrieval by an individual.

24 Claims, 4 Drawing Sheets

DEVICE FOR HOLDING CYLINDRICAL SOCKET HEADS

BACKGROUND OF THE INVENTION

The present invention relates to a device magnetically holding sockets in an original and convenient sequence. In the past, socket heads have been stored in a haphazard fashion in a tool box or drawer resulting in misplacement or loss of tools. Socket heads have also been magnetically affixed to a clumsy oversized holder. The storage of socket heads, as known, has not enhanced the ease of use of the sockets by an individual. Individuals frequently become frustrated due to their inability to identify, locate, retrieve, and or use a particular socket at the time of demand.

Devices for magnetically holding socket heads are known in the art. For example, U.S. Pat. No. 3,405,377, issued Oct. 8, 1968, discloses a magnetic holder having sockets extending vertically downward into the device. U.S. Pat. No. 5,080,230, issued Jan. 14, 1992, discloses a magnetic holder having a plurality of bores for vertical receipt of a particular sized socket. U.S. Pat. No. 4,802,580, issued Feb. 7, 1989, discloses a magnet mounted inside a pair of spaced armature plates for holding sockets. None of these devices provides enhanced magnetic attraction properties while simultaneously minimizing size of the holder, and maximizing visibility of the individual sockets.

SUMMARY OF THE INVENTION

The invention relates to a device for magnetically holding sockets in a desired horizontal sequence. One embodiment of the device is substantially rectangular having a plurality of parallel channels of descending circumference adapted to receive corresponding socket heads from a standard or long socket set. The device promotes a plurality of magnetic arcs, having pole lines parallel to the channels, for engagement to the exterior of the cylindrical sockets. The magnetic attraction properties of the device offer a significant improvement over the prior art while simultaneously providing maximum visibility of the socket heads which facilitate retrieval by an individual.

It is a principal object of the present invention to provide a new and improved holder for socket heads of relatively simple and inexpensive design, construction, and operation which is convenient in size, safe, durable, well-organized, and which enhances an individual's ability to retrieve an individual socket head upon demand without fear of damage to the holder or loss of the socket.

Another object of the invention is to maximize the magnetic attraction properties of the holder for engagement of a set of sockets, while simultaneously maximizing visibility of the sockets, thereby facilitating retrieval by an individual.

Still another object of the invention is to provide a magnetic holder of sockets, minimizing the risk of misplacement or loss of sockets, due to involuntary disengagement of socket heads from the holder upon accidental impact of either the holder or the sockets with an object.

Still another object of the invention is provide a magnetic holder of socket heads of convenient size for efficient use within a tool drawer, chest, and/or box.

Still another object of the invention is to provide a magnetic holder of sockets of simple organizational structure defining channels of descending circumference which facilitates identification of the sockets and their use by an individual.

A feature of the present invention is a plurality of parallel and recessed channels of descending circumference, sized to horizontally receive corresponding socket heads of a standard or long socket set.

Another feature of the present invention is an aperture traversing each channel.

Still another feature of the present invention is a magnet affixed to the holder opposite the channels, and proximal to the apertures, which defines a plurality of magnetic pole lines parallel to the channels adapted for horizontal engagement of either long or standard socket heads.

Still another feature of the present invention is the ability of the magnet to simultaneously attract socket heads for engagement to the device, and position the device in a desired location on a surface.

Still another feature of the present invention is the definition of a series of magnetic arcs of descending circumference which are specifically adapted for receiving engagement of a corresponding socket head.

Still another feature of the present invention is the ability of the plurality of magnetic arcs to establish magnetic circuits upon engagement of the magnetic arcs with the exterior of the socket heads within the device.

Still another feature of one embodiment of the present invention is the ability to separate the socket holder from the base providing flexibility to an individual with respect to positioning and/or relocation of the device.

DETAILED DESCRIPTION OF THE PREFERRED EMBODIMENT

Two forms of the invention are illustrated and described herein. The socket holder is indicated in general by the numeral 10 and socket head is indicated in general by the numeral 5.

In general, the socket holder 10 is rectangular in shape and molded of one-piece construction from plastic or polypropylene material. (FIG. 1) The length of the socket holder 10 may vary to suitably hold any desired number of socket heads 5 ranging from six to thirty-six in number. The width of the socket holder 10 may vary to hold standard, or long, sized socket heads 5. The socket holder 10 is of a convenient size to easily fit into a tool chest, box, or drawer while holding a set of socket heads 5.

Figure 1:
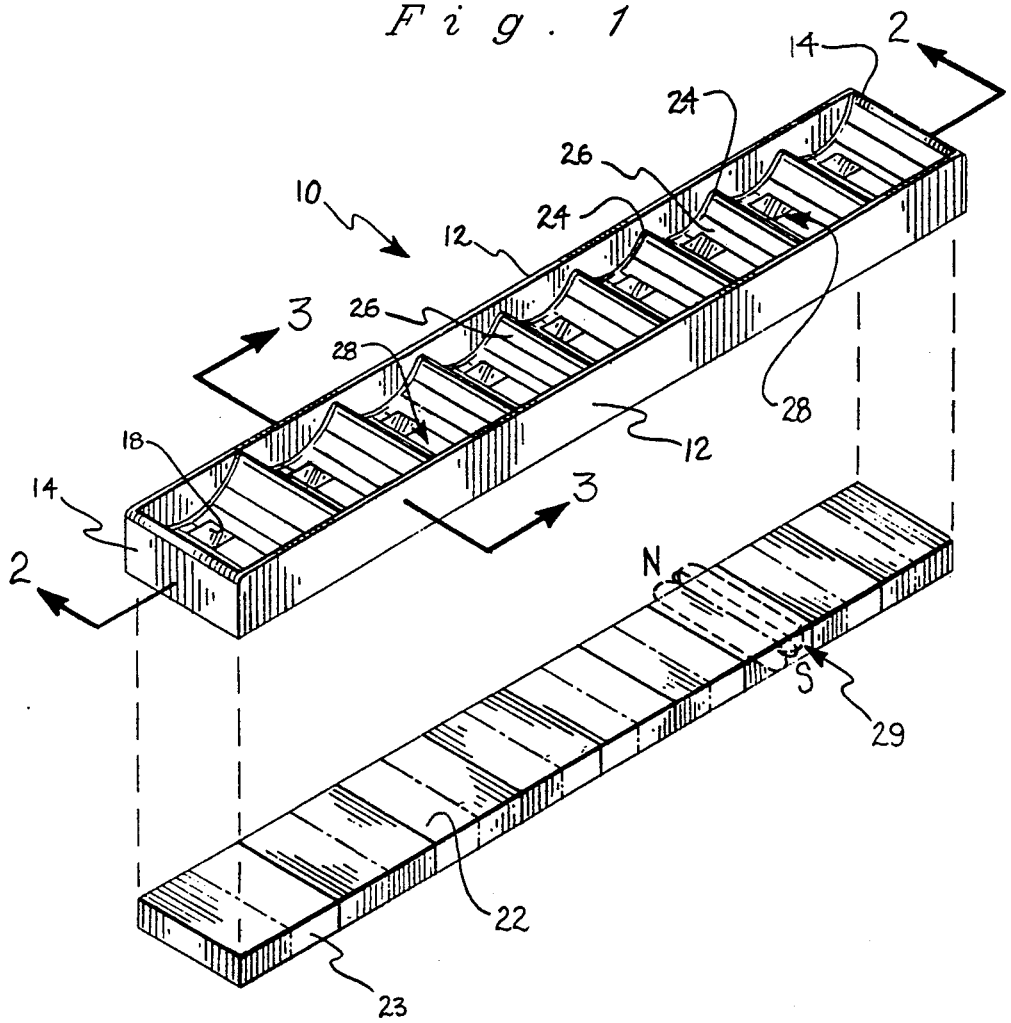
FIG. 1 is an exploded isometric view of the invention showing the magnet separated from the holder.

One embodiment of the socket holder 10 includes a pair of parallel sidewalls 12 and a pair of parallel end walls 14 as shown in FIGS. 1–4. An opposite pair of interior walls 18 traverse the entire length of the bottom of the socket holder 10, between the pair of end walls 14 and parallel to the pair of sidewalls 12. (FIG. 4) The pair of interior walls 18 define a cavity 20 suitably adapted for receiving engagement of a magnet 22. (FIG. 1)

The socket holder 10, including the pair of sidewalls 12 and pair of end walls 14, generally define the area for magnetically holding a plurality of substantially cylindrical socket heads 5.

Figure 2:
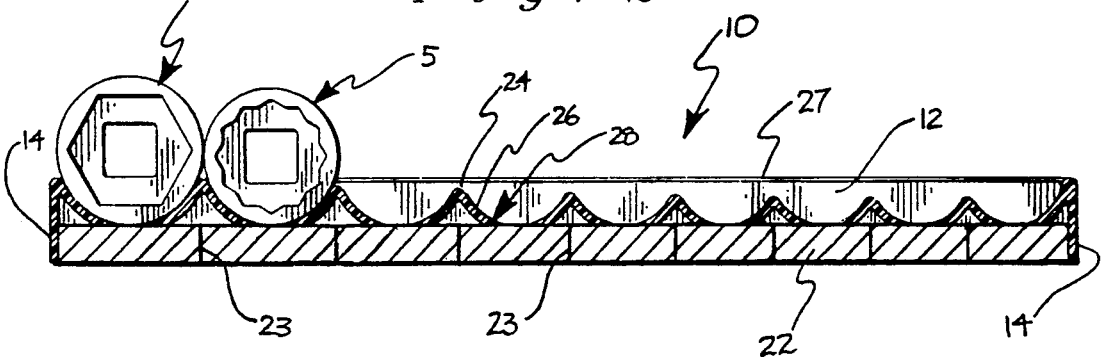
FIG. 2 is a cross-sectional view of the invention and socket heads taken along line 2—2 of FIG. 1.
Figure 3:
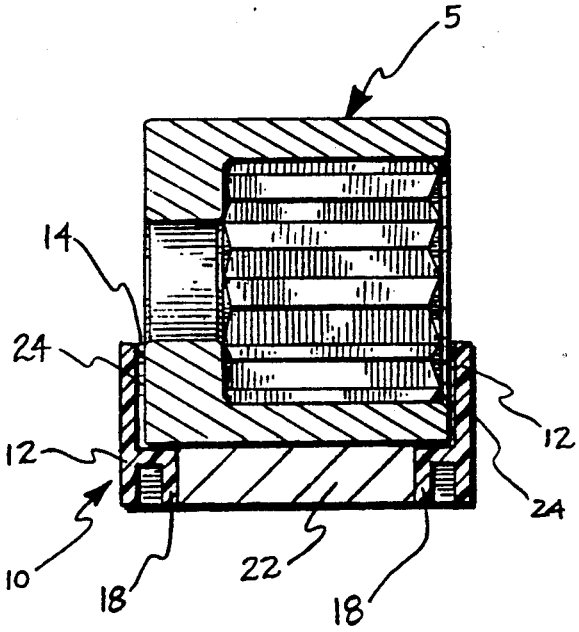
FIG. 3 is a cross-sectional view of the invention and socket heads taken along line 3—3 of FIG. 1.
Figure 4:
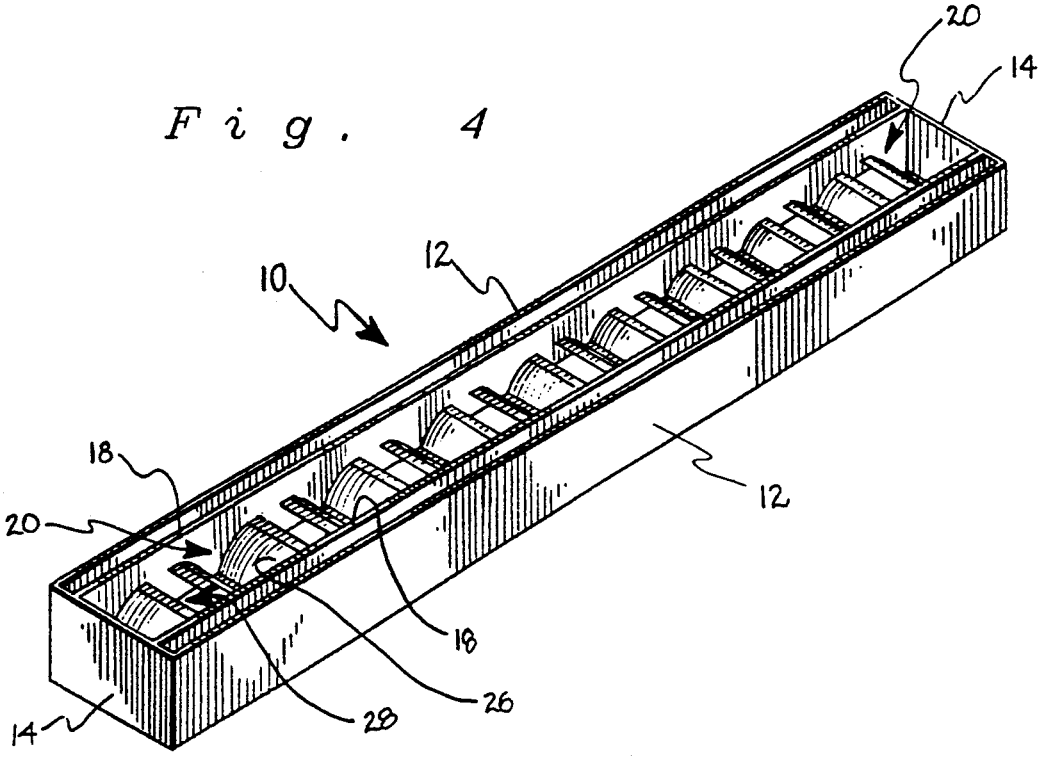
FIG. 4 is an isometric view of the bottom of the invention without the magnet.
Figure 6:
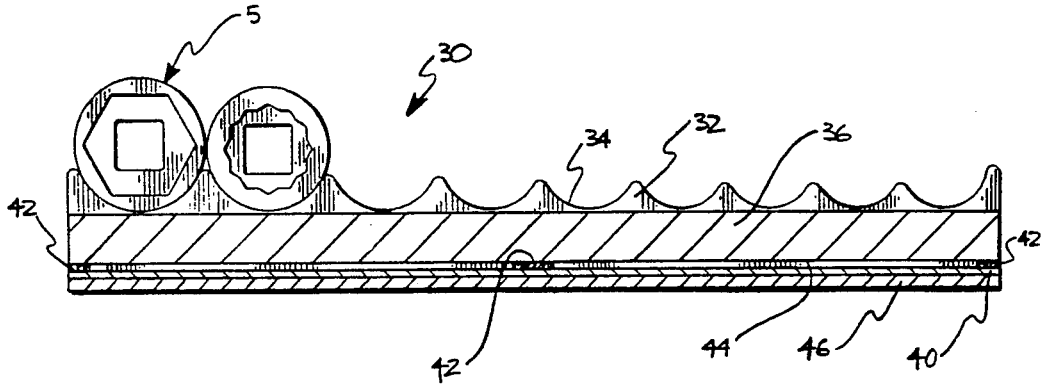
FIG. 6 is a cross-sectional view of an alternative embodiment of the invention and socket heads taken along line 6—6 of FIG. 5.

A plurality of ridges 24 are generally perpendicular to the pair of sidewalls 12 and are parallel to the pair of end walls 14. The ridges 24 are preferably molded into the socket holder 10 during construction. The ridges 24 are generally spaced to define a desired number of channels 26 of either descending or ascending circumference. The channels 26 are recessed below the top edge 27 of the sidewalls 12 and define the location for horizontal receiving engagement of the socket heads 5 of corresponding circumference. The ends of the channels 26 are defined by the sidewalls 12. The channels 26 are semicircular in shape (FIGS. 1, 2 AND 6).

The channels 26 significantly improve the visibility of the socket heads 5 from at least two directions. First, the socket heads 5, may be viewed along the ends as seen in FIG. 2. The parallel, organized, sequential arrangement of the socket heads 5, by descending circumference, significantly enhance an individuals ability to retrieve a particular size socket upon demand. Second, the socket heads 5 may be viewed along the length of the cylindrical sockets. The horizontal positioning of the socket heads 5 maximizes the visibility of any and all marking indicia located along the exposed length of the tool. The ease of identification and retrieval of a particular socket head 5 is thereby significantly enhanced in comparison to the prior art.

An aperture 28 preferably traverses each channel 26 proximal to the bottom of the socket holder 10. (FIGS. 1, 2) Generally, the apertures 28 are rectangular in shape; however, the apertures 28 may be of any preferred shape including but not limited to square, round, or oval at the discretion of the individual. The apertures 28 permit direct magnetic attraction between the magnet 22, positioned in the cavity 20, and the socket heads 5 located in a corresponding channel 26.

A magnet 22 is preferably inserted into and affixed to the cavity 20 of the socket holder 10 below the apertures 28. The magnet 22 preferably contacts a socket head 5 through the aperture 28 along a portion of the cylindrical exterior of the socket head 5. (FIG. 3) Preferably the magnet 22 is formed of one piece construction from a flexible strip of material formed with magnetic material imbedded in non-metallic binding material as known in the art. An example of the material forming the magnet 22 is a NITRILE rubber binder material having imbedded therein strips or rows of magnetic particles. This material is commercially available from Minnesota Mining and Manufacturing Corporation. Alternatively, the magnet 22 may be formed of a series of horizontally positioned magnet pieces 23. (FIG. 1) The magnet pieces 23, following horizontal alignment, are preferably of the same dimensions as a one piece magnet 22. The magnet pieces 23 may be affixed together along the edges of each individual magnetic piece 23, by use of adhesives, so long as the magnetic forces of the magnet 22 are not affected.

The magnet 22 is affixed to the socket holder 10 by any preferred means, including but not limited to flanges located on the sidewalls and end walls 12 and 14, respectively, and/or adhesives attaching the magnet 22 to the bottom of the socket holder 10.

A plurality of pole lines 29, in the preferred embodiment, are specifically directed perpendicular to the sidewalls 12. A pole line 29 centrally traverses each aperture 28 of each channel 26 of the socket holder 10. The pole lines 29 define the magnetic arcs of the magnet 22 for engagement to the exterior of the socket heads 5. The magnet 22 may be polarized to define pole lines 29 in a specific desired direction or location to suit the individual needs of a user. A magnet 22 having pole lines 29 centered within the apertures 28 focuses the magnetic attraction forces of the magnet 22 along the line of contact between a horizontally positioned socket head 5 within a channel 26, and the magnet 22. Preferably the line of magnetic force for the magnet 22 is focused along the pole lines 29 for engagement to a socket head 5.

Improved engagement between the socket holder 10 and the socket heads 5 occurs due to the increased exterior surface area of the socket heads 5 in magnetic contact with the magnet 22. The improved magnetic attraction promotes utility of the invention by minimizing undesired separation of the socket heads 5 from the socket holder 10.

The magnet 22 is generally of sufficient strength to affix and hold a socket holder 10, containing numerous socket heads 5, in a particular location upon a surface during use.

In operation, sequential organized positioning of socket heads 5 of a socket set significantly enhances the retrieval of a particular socket head 5 upon demand by an individual. The socket heads 5 are held in a preferred position by the pair of sidewalls 12, ridges 24 which define the corresponding channel 26, apertures 28, and magnet 22.

One side of the magnet 22 is exposed through the apertures 28 for engagement to the socket heads 5 (FIG. 1). The opposite side of the magnet 22 is also exposed over its entire length for engagement to a metallic surface such as a tool bench. The exposure of an entire surface of the magnet 22 opposite the channels 26 provides the means for placement of the socket holder upon a vertical, horizontal, inclined, and/or inverted surface. The magnetic attraction forces exerted upon the socket heads 5 by the magnet 22 significantly exceed the force of gravity acting on the socket heads 5. Involuntary separation of the socket heads 5 from the socket holder 10 during inverted positioning of the holder 10 is thereby prevented. In addition, the magnetic attraction forces of the magnet 22 are of sufficient strength t prevent involuntary separation of the socket heads 5 from the socket holder 10 upon accidental impact between the socket holder 10 and an object. The magnetic positioning of the socket holder 10 upon a surface, eliminates the cumbersome attaching of a device by the use of screws, bolts and nuts, and/or adhesives.

Figure 5:
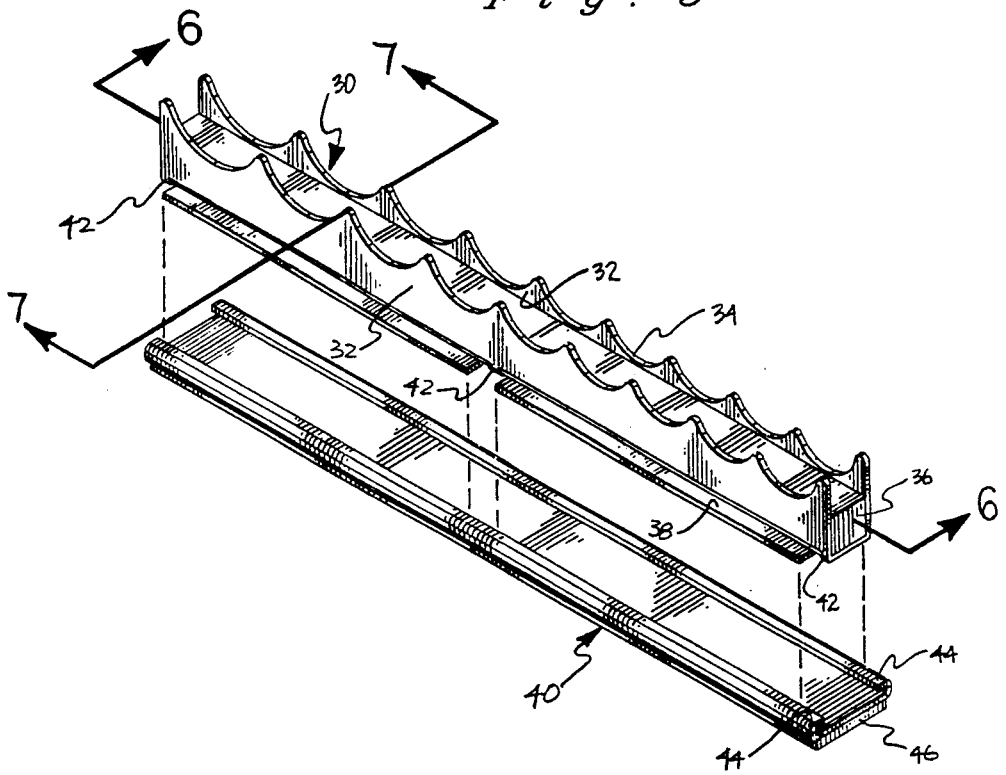
FIG. 5 is an exploded isometric view of an alternative embodiment of the invention.
Figure 7:
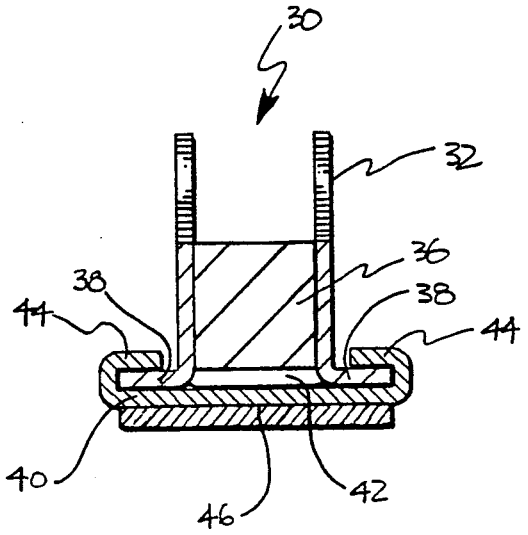
FIG. 7 is a cross-sectional view of an alternative embodiment of the invention taken along line 7—7 of FIG. 5.
Figure 8:
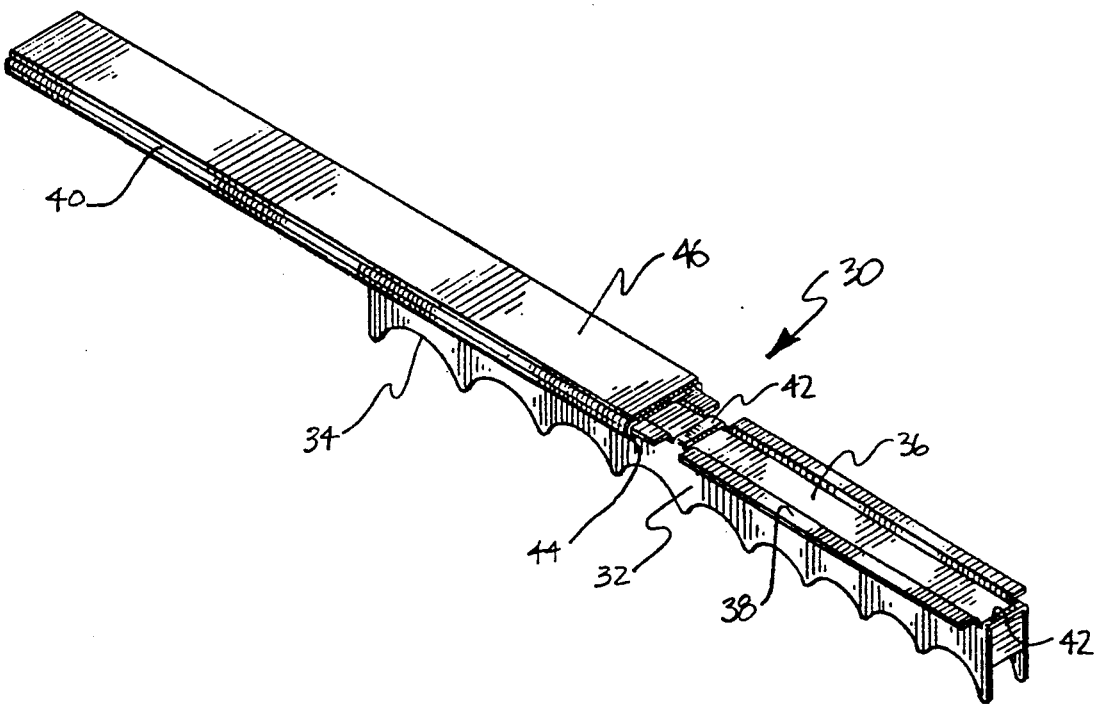
FIG. 8 is an expanded bottom view of an alternative embodiment of the invention.

An alternative embodiment of the invention is illustrated in FIG. 5. This embodiment is formed substantially of metal components. The socket rack 30, shown in FIG. 5, in general includes a pair of parallel barriers 32, a plurality of parallel troughs 34, and a substantially square magnet 36. The plurality of parallel troughs 34 are preferably milled into the pair of barriers 32 as known in the art. Preferably the barriers 32 are formed of metal. The troughs 34, like the channels 26, are aligned and of descending circumference as earlier described. One noticeable distinction of the troughs 34 is the absence of apertures. In this embodiment, the area below the troughs 34 is substantially open and adapted for receiving engagement of a square magnet 36 as shown in FIGS. 5 and 7. A pair of channel flanges 38 diverge outwardly, substantially perpendicular from the lower portion of the pair of barriers 32 opposite the troughs 34 (FIG. 5). The channel flanges 38 provide the means for engagement of the socket rack 30 to the base indicated in general by the numeral 40. As seen in FIG. 8, the outwardly extending channel flanges 38 are proximal to the substantially open bottom of the socket rack 30. The square magnet 36 is preferably held into position within the socket rack 30 by at least one centrally located bridge 42 extending laterally between the pair of barriers 32 proximal to the channel flanges 38 (FIG. 8). In this embodiment, preferably a bridge 42 is also positioned at each oppositely divergent end of the socket rack 30 (FIGS. 5, 8).

The base 40 is generally rectangular, preferably having the same length as the socket rack 30. The base 40 is preferably wider than the extending channel flanges 38. The base 40 has a pair of opposite channel guides 44. Each channel guide 44 initially extends vertically upward from the base 40, then extends horizontally inward, centrally converging toward each other, to define the pair of channel guides 44. The pair of channel guides 44 are adapted for sliding and receiving engagement of the pair of channel flanges 38, which affix the socket rack 30 the base 40 (FIGS. 7 and 8).

Preferably a second flat rectangular magnet 46 is affixed to the base 40 opposite the channel guides 44. The second magnet 46 may be affixed to the base 40 by any conventional means including but not limited to adhesives.

The square magnet 36 is generally positioned in contact with the barriers 32 and is retained in position by the bridges 42. The top of the square magnet 36 preferably is below the troughs 34 over the entire length of the socket rack 30. The base 40, having the second flat magnet 46, provides an individual with the ability to temporarily separate the socket rack 30 from the base 40 for transportation to a desired location. The second flat magnet 46 also provides an individual with a convenient means for relocation of the base 40 and the socket rack 30 to a desired position, thereby significantly improving the utility to an individual. The second flat magnet 46 is preferably adapted for mounting the base 40 and the socket rack 30 to a desired inclined, vertical, horizontal, or inverted surface.

The square magnet 36 and the second flat magnet 46 of this embodiment are generally constructed of the same material as earlier described. The square magnet 36 of this embodiment has pole lines which are substantially parallel to the pair of barriers 32 and perpendicular to the troughs 34. In this embodiment, the engagement between the square magnet 36 and the metallic barriers 32 enhance the attraction forces of the magnetic arcs as known in the art. The magnet arcs of the square magnet 36, in conjunction with the troughs 34 significantly improve the engagement between the metallic cylindrical socket heads 5 and the socket rack 30 over the known art. The square magnet 36 and the second flat magnet 46 of this embodiment encompass the features, functions, advantages, attributes, and purpose of the alternative embodiment, as previously described, which in all remaining respects are identical to each other.

The aligned troughs 34 are also preferably adapted to horizontally receive socket heads 5 of corresponding circumference. The troughs 34 of this embodiment encompass the features, functions, advantages, attributes, and purpose of the alternative embodiment as previously described, which in all remaining respects are identical to each other.

This embodiment may also vary in size and width as earlier described. In addition, this embodiment encompasses the functions, advantages, attributes, and purpose of the alternative embodiment as previously described, which in all remaining respects are identical to each other.

The present invention may be embodied in other specific forms without departing from the spirit or essential attributes thereof; therefore, the illustrated embodiment should be considered in all respects as illustrative and not restrictive, reference being made to the appended claims rather than to the foregoing description to indicate the scope of the invention.

What is claimed is:

1. A device for holding cylindrical socket heads of varying circumference comprising:

(a) a body having a pair of parallel sidewalls and a pair of parallel end walls;

(b) a plurality of ridges traversing said body perpendicular to said sidewalls, said ridges defining a plurality of parallel channels of descending circumference;

(c) a rectangular aperture traversing each of said channels; and (d) a magnet engaged to said pair of sidewalls, and said pair of end walls opposite said channels, said magnet is positioned proximal to said apertures, said magnet having a plurality of pole lines perpendicular to said pair of sidewalls, one of said pole lines centrally positioned within each of said channels, said magnet further engaging a socket head of corresponding circumference to one of said channels, maximizing visibility of said socket head.

2. The device according to claim 1, wherein said plurality of channels are semicircular in shape inside said body.

3. The device according to claim 2, wherein said magnet is engaged to a magnetic surface for desired positioning of said device.

4. The device according to claim 3, wherein said magnet further engages said socket head to said magnet along a corresponding said pole line when said socket head is positioned in one of said channels.

5. The device according to claim 4, wherein said magnet is of one-piece construction.

6. The device according to claim 4, wherein said magnet is comprised of a plurality of horizontally aligned magnet pieces.

7. The device according to claim 6, wherein said magnet pieces are affixed to each other.

8. A device for holding cylindrical socket heads of varying circumference comprising:

(a) a body having a pair of parallel sidewalls and a pair of parallel end walls;

(b) a plurality of ridges positioned perpendicular to said side walls traversing said body, said ridges being spaced to define a plurality of parallel channels of differing circumference inside said body, said ridges further defining a magnet receiving area, each of said plurality of channels being semicircular in shape, each of said plurality of channels adapted to receive a socket head of corresponding circumference;

(c) a substantially rectangular aperture traversing each of said channels; and (d) a magnet engaged to said body within said magnet receiving area, said magnet positioned proximal to said apertures, said magnet comprising a plurality of magnetic pole lines perpendicular to said sidewalls.

9. The device according to claim 8, wherein a corresponding said magnetic pole line is centrally positioned within each of said channels.

10. The device according to claim 9, wherein said magnet engages a socket head of corresponding circumference along one of said pole lines of said magnet when said socket head is positioned in one of said channels.

11. The device according to claim 10, wherein said magnet is of one-piece construction.

12. The device according to claim 10, wherein said magnet is comprised of a plurality of horizontally aligned magnet pieces.

13. The device according to claim 12, wherein said plurality of magnet pieces are affixed to each other.

14. The device according to claim 13, wherein said magnet is engaged to said pair of end walls, and said pair of sidewalls.

15. The device according to claim 14, wherein said magnet is engaged to a magnetic surface for desired positioning of said device.

16. A device for holding cylindrical socket heads of varying circumference comprising:

(a) a body having a base and a pair of parallel barriers formed of a metal material;

(b) a plurality of spaced and aligned depressions traversing said parallel barriers defining a plurality of troughs of differing circumference where each of said troughs is adapted to receive a socket head of corresponding circumference; and (c) a magnet engaged to said base, said magnet positioned proximal to said troughs, said magnet having pole lines parallel to said barriers.

17. The device according to claim 16, wherein said magnet is engaged to said metallic barriers, said magnet further defining a plurality of magnetic arcs, said magnetic arcs centrally and horizontally engaging a socket head of corresponding circumference within each of said troughs.

18. The device according to claim 17, wherein said magnet is engaged to a magnetic surface for desired positioning of said device.

19. The device according to claim 18, wherein said plurality of troughs are semicircular in shape.

20. The device according to claim 19, wherein each of said barriers further comprise an outwardly extending channel flange positioned opposite said troughs.

21. The device according to claim 20, wherein said base further comprises a pair of oppositely aligned channel guides for sliding and receiving engagement of said outwardly extending channel flanges of said pair of barriers.

22. The device according to claim 21, wherein said base further comprises a second magnet affixed to said base opposite said pair of oppositely aligned channel guides.

23. The device according to claim 22, wherein said second magnet is affixed to said base for engagement to a magnetic surface for desired positioning of said device.

24. The device according to claim 23, wherein said magnet is of one-piece construction.

* * * * *

UNITED STATES PATENT AND TRADEMARK OFFICE

CERTIFICATE OF CORRECTION

PATENT NO. : 5,316,143

DATED : May 31, 1994

INVENTOR(S) : Billy L. Horn

It is certified that error appears in the above-identified patent and that said Letters Patent is hereby corrected as shown below:

In Column 1, line 6, after the word "device", please insert the word --for--.

In Column 4, line 57, after the word "strength", please delete the letter "t" and insert the word --to--.

Signed and Sealed this

Thirtieth Day of August, 1994

*Attest:*

*Attesting Officer*

Bruce Lehman

BRUCE LEHMAN

*Commissioner of Patents and Trademarks*